US007467817B2

(12) United States Patent
Vandomel

(10) Patent No.: US 7,467,817 B2
(45) Date of Patent: Dec. 23, 2008

(54) ARTICULATED ROD

(75) Inventor: Yannick Vandomel, Toulouse (FR)

(73) Assignee: Airbus France, Toulouse (FR)

( * ) Notice: Subject to any disclaimer, the term of this patent is extended or adjusted under 35 U.S.C. 154(b) by 0 days.

(21) Appl. No.: 11/527,148

(22) Filed: Sep. 26, 2006

(65) Prior Publication Data

US 2007/0138807 A1 Jun. 21, 2007

(30) Foreign Application Priority Data

Sep. 27, 2005 (FR) ..... 05 52892

(51) Int. Cl.
*E05C 17/04* (2006.01)

(52) U.S. Cl. ..... 292/262

(58) Field of Classification Search ..... 292/262
See application file for complete search history.

(56) References Cited

U.S. PATENT DOCUMENTS 1,852,990 A * 4/1932 Wandtke ..... 292/262
1,967,592 A * 7/1934 Rawlings ..... 292/263
2,643,420 A * 6/1953 Schwartz ..... 49/458
3,877,108 A * 4/1975 Del Fiacco ..... 16/49
4,218,083 A * 8/1980 Dillemuth ..... 292/262
4,789,123 A * 12/1988 Mattsson ..... 248/240.4
4,811,440 A * 3/1989 Scott ..... 7/100
5,020,835 A * 6/1991 Poe ..... 292/127

FOREIGN PATENT DOCUMENTS

DE 24 08 889 A1 9/1975
DE 42 25 328 A1 2/1994
FR 2 377 508 8/1978

* cited by examiner

*Primary Examiner*—Patricia L Engle
*Assistant Examiner*—Kristina R Fulton
(74) *Attorney, Agent, or Firm*—Patterson, Thuente, Skaar & Christensen, P.A.

(57) ABSTRACT

An articulated rod comprising at least two articulated segments, a first segment being rotatably mounted on a connecting element that is fixed in relation to the articulated rod, the said articulated rod also comprising a locking device capable of maintaining the articulated rod in the open or closed position characterised in that the locking device locks the articulated rod at the connection between the first segment and the fixed connecting element. The invention also relates to a hatch fitted with a door capable of being maintained in the open or closed position by at least one articulated rod according to the invention. More generally, the invention also relates to the use of an articulated rod according to the invention for transmitting a displacement movement to a moving connecting element to which the said articulated rod is connected.

10 Claims, 3 Drawing Sheets

ARTICULATED ROD

RELATED APPLICATION

The present application claims priority to French Application No. 05 52892 filed Sep. 27, 2005.

TECHNICAL FIELD

The invention relates to a connecting rod comprising at least two segments that are hinged, one in relation to the other. More precisely, the invention relates to a locking device capable of maintaining the articulated rod in the open, retracted or partially retracted position. The invention may be used when it is necessary to maintain a moving element in a given position. For example, the invention may be used to open and close, and more particularly to keep open or closed, a hatch.

BACKGROUND OF THE INVENTION

An articulated rod is generally provided with two segments rotatably connected together at a first end. The second end of one of the two segments is connected to a fixed wall. The second end of the second segment is then connected to a moving wall, the moving wall thus being capable of being displaced relative to the fixed wall by simply extending and retracting the articulated rod.

In the case of a hatch, for example, the first segment of the articulated rod is mounted on the wall bounding the cavity of the hatch, whilst the second segment is rotatably mounted on the door of the hatch which must be opened and closed. In the retracted position of the rod the two segments extend one beside the other and the door covers the opening of the hatch. In the extended position of the rod the two segments extend in the direction of their mutual extension. The door does not obstruct the opening of the hatch.

In order to maintain the hatch in the open position a method is known for locking the articulated rod so that the said articulated rod does not retract accidentally or in an untimely manner.

To achieve this the locking device normally used tends to lock the articulated rod at the joint between the two segments of the articulated rod. More precisely, a sliding piece is mounted translatorily about one of the two segments of the rod, and when the two segments extend in the direction of mutual extension the sliding piece is slid in the direction of the connection between the two segments. Once the sliding piece is level with the articulated joint between the two segments, and to the extent that the contour of the sliding piece more or less follows the contour of the two segments at the said joint, the articulated rod can no longer be retracted. When the articulated rod is to be retracted again it is sufficient to slide the sliding piece along one of the two segments so as to release the articulated joint. It is then possible to retract the articulated rod.

The locking device of prior art is of simple design since it is formed from a tubular piece having a diameter that is slightly larger than the diameter of the two segments of the rod.

However, such a locking device only allows an articulated rod to be locked in the extended position. Moreover, when it is necessary to maintain the articulated rod not in the extended but in the retracted position, the locking device of prior art is not transposable. Furthermore, because of the presence of the lockable articulated joint of prior art, the extension of such an articulated rod does not have perfect kinematics. Such an articulated rod does not therefore give entire satisfaction in a confined space. For example, the articulated joint may knock uncontrollably against the walls of a hatch of small volume.

SUMMARY OF THE INVENTION

The object of the invention is to provide a locking device for an articulated rod that can be used as effective for a rod that has to be maintained in the retracted position as for a rod that has to be maintained in an extended position. Moreover, the locking device of the invention allows the rod to be locked automatically, i.e. without specific manual manipulation, by simply setting the segments of the articulated rod in motion. Moreover, the articulated rod according to the invention has extension kinematics such those can be used in any type of space, particularly in a confined space.

To achieve this the locking device according to the invention is no longer located at the joint between the two segments of the articulated rod but at the joint between one of the two segments of the articulated rod and a fixed wall on which the articulated rod is rotatably mounted. The articulated rod comprises at least two segments, the locking device according to the invention being located on only one of the segments of the articulated rod. The locking device according to the invention is arranged on one hand on the fixed wall to which the articulated rod is connected and on the other hand on the articulated rod itself. The fixed wall comprises for example, a stop against which the articulated rod is supported, the stop blocking the rotation of the articulated rod. The lock for the articulated rod is an elastic lock which may be engaged automatically, by simple movement of the articulated rod in the direction of the retracted or extended position. The release of the locking device according to the invention requires a simple manipulation in order to release the articulated rod from the stop.

The object of the invention is therefore an articulated rod comprising at least two articulated segments, a first segment being rotatably mounted on a connecting element that is fixed in relation to the articulated rod, the said articulated rod also comprising a locking device capable of maintaining the articulated rod in the open or closed position, wherein the locking device locks the articulated rod at the connection between the first segment and the fixed connecting element.

According to the exemplary embodiments of the articulated rod of the invention it is possible to provide all or some of the following additional characteristics:

- the locking device comprises stopping means projecting from the first segment of the articulated rod and a notch arranged on the fixed connecting element, the stopping means being capable of engaging elastically in the notch,
- the locking device comprises a slide translatorily mounted on the first segment of the articulated rod, the stopping means being mounted fixedly on the said slide,
- the locking device comprises an elastic return elastic means capable of engaging and disengaging the stopping means of the notch,
- the elastic return means is mounted between the slide and the first segment of the articulated rod,
- the stopping means are mounted translatorily on the articulated rod and diametrically cross the first segment of the said articulated rod,
- the first segment of the articulated rod is provided with an axial oblong orifice, the stopping means being mounted translatorily in the said oblong orifice which they cross.

The invention also relates to a hatch fitted with a door that is capable of being maintained in the open or closed position by at least one articulated rod of the invention.

The invention also relates to the use of an articulated rod according to the invention for transmitting a displacement movement to a moving connecting element to which the said articulated rod is connected.

BRIEF DESCRIPTION OF THE DRAWINGS

The invention will be better understood on reading the following description and on examining the figures accompanying it. The latter are presented for information only and in no way limit the scope of the invention. The figures show.

DETAILED DESCRIPTION OF THE DRAWINGS

Figure 1A:
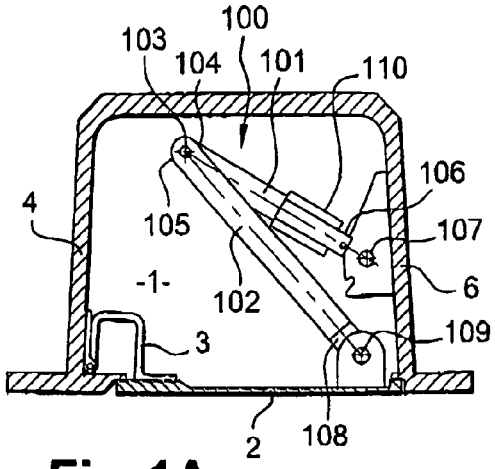
FIGS. 1A, 1B and 1C are diagrammatic representations of an articulated rod according to the invention in the fully retracted position (FIG. 1A), partially extended (FIG. 1B) and extended (FIG. 1C)
Figure 1B:
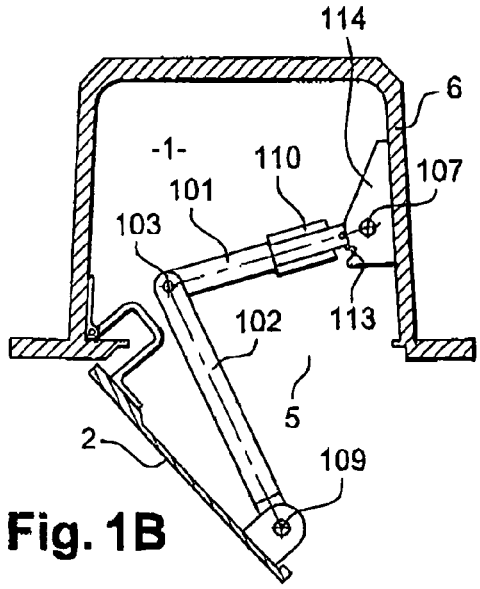
Figure 1C:
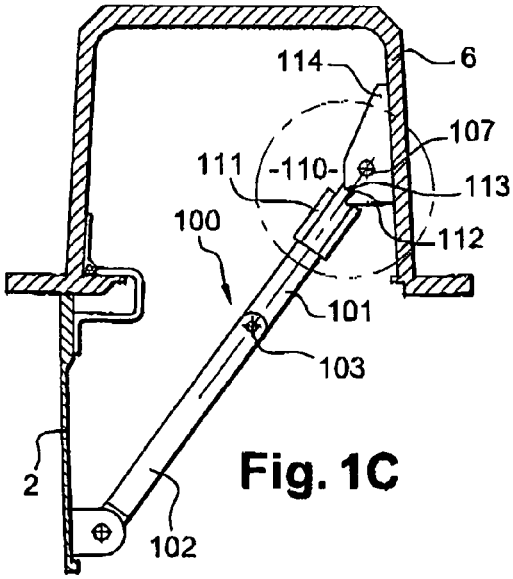

FIGS. 1A, 1B and 1C depict a hatch 1 comprising a door 2 rotatably mounted, by an articulated hinge 3, on a first fixed vertical wall 4 of hatch 1. Door 2 may be closed (FIG. 1A) or open (FIGS. 1B and 1C) to provide access to an orifice 5. Door 2 is connected to a second fixed vertical wall 6 of hatch 1 by an articulated rod 100 according to the invention.

Articulated rod 100 comprises a first segment 101 and a second segment 102, rotatably connected to one another by means of a central joint 103. More precisely, a first end 104 of first segment 101 and a first end 105 of second segment 102 are rotatably mounted one in relation to the other so that first segment 101 and second segment 102 are able to extend one alongside the other, in the retracted position of the articulated rod, and in the extension of the other in the extended position of the articulated rod. Second end 106 of first segment 101, opposed to first end 104, is rotatably mounted 107 on the second fixed vertical wall 6 of hatch 1. Second end 108 of second segment 102 of articulated rod 100 is rotatably mounted 109 on door 2 of hatch 1.

In FIG. 1A door 2 blocks orifice 5 of hatch 1. Articulated rod 100 is then in the retracted position.

When door 2 is pulled towards the outside of hatch 1, providing access to orifice 5, segments 101 and 102 of articulated rod 100 separate from one another by rotation of central joint 103 on the one hand, and joints 107 and 109 on the other, the latter connecting first segment 101 and articulated rod 100, respectively, to the second fixed vertical wall 6 of plate 1 and second segment 102 of articulated rod 100 to door 2.

The width of separation of segments 101 and 102 of articulated rod 100 enables the two segments 101 and 102 to extend one in the extension of the other, as shown in FIG. 1C. Articulated rod 100 therefore opens at 180°. Door 2 has undergone a rotation of 90° and is in the open position.

A locking device 110 of articulated rod 100 in the extended position is arranged at second end 106 of first segment 101 of articulated rod 100. Locking device 110 according to the invention automatically engages when articulated rod 100 is in the extended position. More precisely, the locking mechanism is progressively engaged as door 2 opens, corresponding to the orifice of articulated rod 100.

Figure 2:
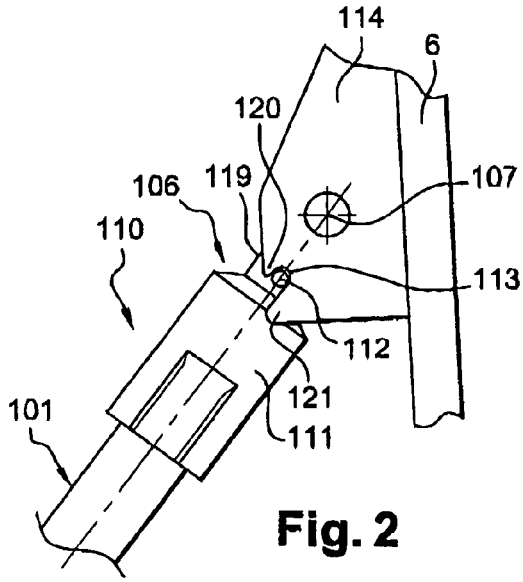
FIG. 2 is an enlargement of FIG. 1C in the location of the locking device according to the invention.

As shown in FIG. 2, locking device 110 comprises a slide 111 provided with stopping means 112. Stopping means 112 comprise at least one protuberance, the said protuberance 112 being lodged in a notch 113 arranged on a fixed plate 114 integral with the second fixed vertical wall 6 of hatch 1. Protuberance 112 is retained in notch 113 by the actual shape of the said notch 113, which blocks the rotation of first segment 101 of articulated rod 100 at joint 107 connecting the said first segment 101 to the second fixed vertical wall 6 of hatch 1. Since the rotation of first segment 101 is blocked, the rotation of central joint 103, connecting segments 101 and 102, is also blocked. Articulated rod 100 is therefore locked and maintained in its extended position by locking the connection between first segment 101 and the second fixed vertical wall 6 of hatch 1.

Figure 3:
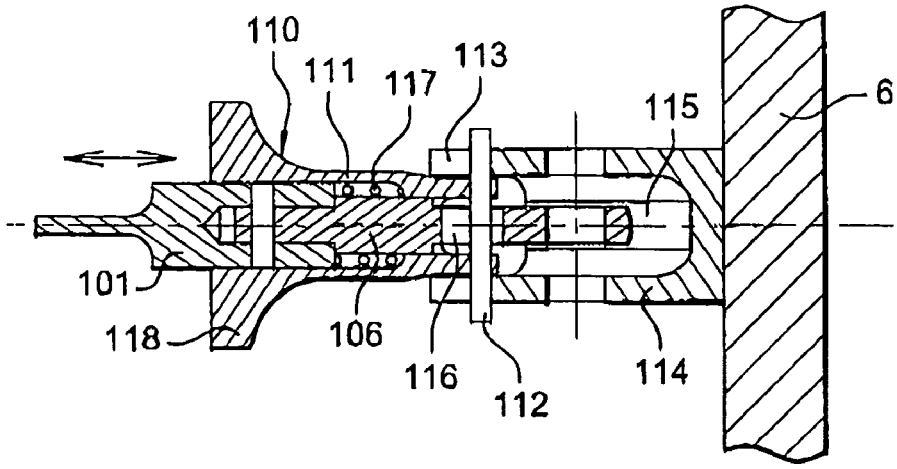
FIG. 3 is a diagrammatic representation, in section, of the locking device according to the invention.
Figure 4:
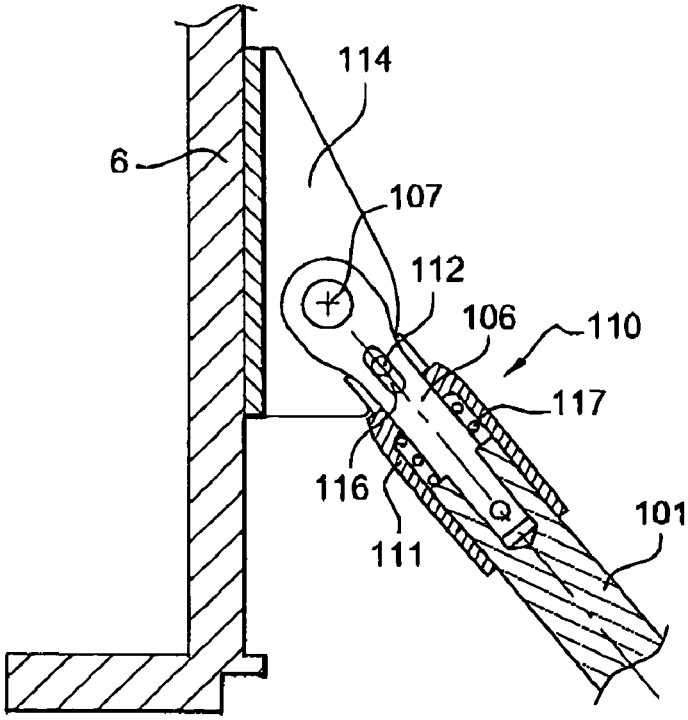
FIG. 4 is another diagrammatic representation, in section, of the locking device according to the invention.

FIGS. 3 and 4 show in greater detail locking device 110 according to the invention, in longitudinal section viewed from above (FIG. 3), and in longitudinal section viewed from the side (FIG. 4).

As shown in FIG. 3, plate 114 has a general U-shape and second end 106 of first segment 101 is partially lodged in cavity 115 of U-shaped plate 114.

A stop is formed by a rod 112 diametrically crossing slide 111 on the one hand and second end 106 of first segment 101 of articulated rod on the other. Rod 112 is fixed on slide 111. Slide 111 is translatorily mounted along second end 106 of first segment 101. Where rod 112 crosses second end 106 of first segment 101, and to allow the displacement of rod 112 along the said second end 106, at the same time as that of slide 111, the said rod 112 crosses an oblong orifice 116 arranged in the body of second end 106 of first segment 101. Oblong orifice 116 is axial in that it extends along the length of segment 101. Rod 112 may therefore be displaced along first segment 101 of articulated rod 100, whilst being displaced between the two ends of oblong orifice 16. FIG. 4 shows, more precisely, the elongated shape of oblong orifice 116 arranged in the body of second end 106 of first segment 101 of articulated rod 100, in which body rod 112 is displaced.

As shown in FIG. 3, rod 112 abuts in a notch 113 arranged on plate 114. The stop formed by notch 113 is a double stop since it comprises two wedges 120 and 121 (shown in FIG. 2) between which rod 112 is retained, preventing the rotation of second end 106 of first segment 101 of articulated rod 100 in both directions.

The engagement of rod 112 in notch 113 is elastic because of the presence of a spring 117 mounted about second end 106 of first segment 101 and arranged between the said second end 106 and slide 111.

The spring is in the position of rest, i.e. not compressed, when locking device 110 is not engaged. As the articulated rod is extended slide 111 is pushed back in the direction of central joint 103, compressing spring 117. More precisely, rod 112 slides along outer contour 119 of plate 114, causing slide 111 to slide. As soon as rod 112 reaches notch 113, spring 117 tends to regain the position of rest and therefore pushes back slide 111 and rod 112 towards plate 114. Rod 112 is then locked in notch 113.

To enable articulated rod 100 to rotate again and hence retract, it is necessary to constrain spring 117 by causing slide 111 to slide in the direction of central joint 103 so that rod 112 also slides in the direction of the said central joint 103 in order to dislodge the said rod 112 from notch 113. The sliding of slide 111 towards central joint 103 may, for example, be facilitated by the presence of a protrusion 118 arranged on the said slide 111 (FIG. 3). Protrusion 118 serves to support the fingers of the user to enable him to exert a pressure on the said slide 111 so that it slides along first segment 101. When rod 112 is disengaged from notch 113, slide 111, which is moved back around the high end 106 of first segment 101 by spring 117 is released, which spring tends to return to the position of rest. The displacement of articulated rod 100 is then made possible again because of the release of joint 107 connecting second end 106 of first segment 101 to the second fixed vertical wall 6 of hatch 1.

Figure 5A:
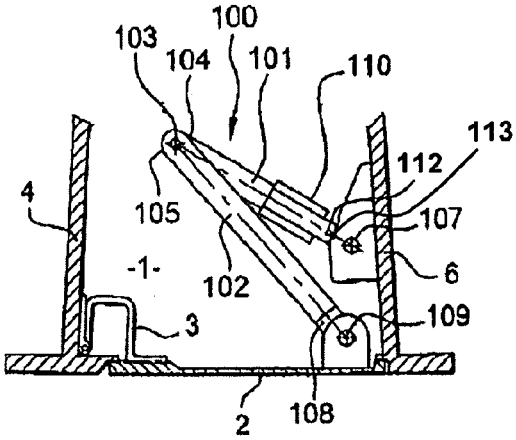
FIGS. 5A, 5B and 5C are diagrammatic representations of and articulated rod according to an embodiment of the invention in the fully retracted position (FIG. 5A), partially extended (FIG. 5B) and extended (FIG. 5C).
Figure 5B:
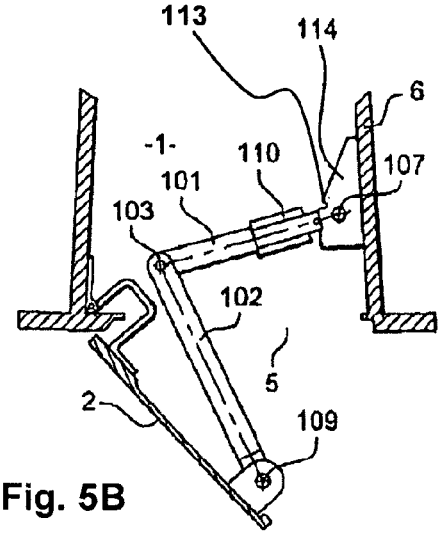
Figure 5C:
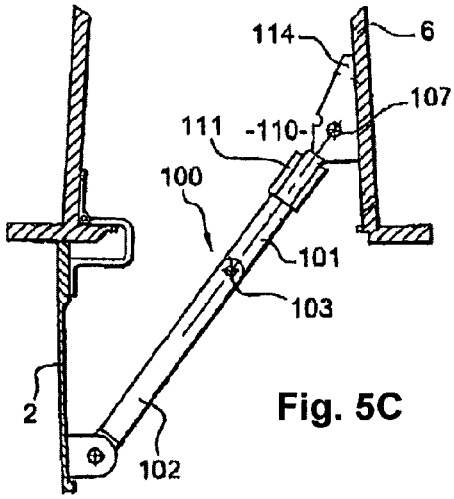

Of course it is possible according to the position of notch 113 on plate 114, i,e. by changing and adapting the position of notch 113 on plate 114 and the position of plate 114 itself on the second fixed vertical wall 6 of plate 1, to use locking device 110 of the invention to lock articulated rod 100 in the retracted position, the unlocking then enabling the articulated rod to be extended, as illustrated in FIGS. 5A-5C. For example, it is possible to use articulated rod 100 according to the invention to maintain a door in the closed position. In particular, it may be useful to use such an articulated rod 100 to maintain a door arranged on an aircraft in the closed position. For example, the door, accessible from the interior of the aircraft, may be displaced towards the interior of the said aircraft. The door is subject to external pressures which tend to open the said door. Locking device 110 of articulated rod 100 maintains the said articulated rod 100 in the retracted position so that the door is maintained is the closed position, despite the pressures being exerted against it. To open the door it is necessary to release manually, from the interior, articulated rod 100. It is also possible to provide for locking of articulated rod 100 in the partially open position.

Locking device 110 for articulated rod 100 according to the invention may therefore be used to maintain an articulated rod 100 in the closed, partially extended or fully extended position, according to the requirements.

The invention claimed is:

1. An articulated rod assembly for selectively and fixedly positioning a pivotable member with respect to a structure that the pivotable member is pivotally and operably coupled to, the articulated rod assembly comprising:

a first connecting element and a second connecting element, each connecting element being fixedly positioned on the structure, wherein the pivotable member is pivotally coupled to the first connecting element;

a rod having a first segment and a second segment, the two segments rotatably coupled together at a first end of the first segment and a first end of the second segment, wherein the first segment is rotatably coupled to the second connecting element at a generally opposing second end of the first segment, and wherein the second segment is rotatably coupled to the pivotable member at a generally opposing second end of the second segment;

a locking device adapted to selectively fix the first segment and the second connecting element with respect to each other such that a pivoting motion between the first segment and the second connecting element is inhibited, wherein the locking device comprises:

a slide member slidably positioned proximate the second end of the first segment of the rod, the slide member including a stop fixedly positioned with respect to the slide member, the stop defining a protuberance, a biasing device adapted to bias the slide member for slidable movement along the first segment toward a contour of the second connecting element, and a notch defined by the contour of the second connecting element, wherein the slide member moves along the contour of the second connecting element as the first segment pivots with respect to the second connecting element, and wherein the stop is releasably received in the notch thereby inhibiting the pivoting motion between the first segment and the second connecting element, and wherein the stop is disengaged from the notch by slidable movement of the slide member away from the second connecting element thereby allowing movement of the slide member along the contour of the second connecting element and pivoting motion between the first segment and the second connecting element.

2. The articulated rod assembly according to claim 1, wherein the biasing device comprises a compression spring.

3. The articulated rod assembly according to claim 1, wherein the biasing device is positioned between the slide and the first segment of the rod.

4. The articulated rod assembly according to claim 1, wherein the stop diametrically crosses the first segment of the rod.

5. The articulated rod assembly according to claim 1, wherein the first segment of the rod is provided with an axial oblong orifice, and wherein the stop diametrically crosses the oblong orifice and is translatorily positioned within the oblong orifice.

6. A method of use of the articulated rod assembly according to claim 1, the method comprising:

transmitting a displacement movement to a third connecting element fixedly positioned on the pivotable member, the second end of the second segment of said rod being rotatably mounted to the third connecting element.

7. The articulated rod assembly according to claim 1, wherein the structure comprises a hatch and the pivotable member comprises a door.

8. The articulated rod assembly according to claim 1, wherein the pivotable member is maintained in an open position with respect to the structure when the stop is engaged within the notch, such that an interior housing defined by the structure is accessible.

9. The articulated rod assembly according to claim 1, wherein the pivotable member is maintained in a closed position with respect to the structure when the stop is engaged within the notch, such that access to an interior housing defined by the structure is not accessible.

10. The articulated rod assembly according to claim 1, wherein the first connecting element is a hinge.

* * * * *